US007614464B2

(12) United States Patent
Paasonen

(10) Patent No.: US 7,614,464 B2
(45) Date of Patent: Nov. 10, 2009

(54) ROCK DRILL MACHINE

(75) Inventor: Hannu Paasonen, Nokia (FI)

(73) Assignee: Doofor Oy, Nokia (FI)

( * ) Notice: Subject to any disclaimer, the term of this patent is extended or adjusted under 35 U.S.C. 154(b) by 0 days.

(21) Appl. No.: 11/861,783

(22) Filed: Sep. 26, 2007

(65) Prior Publication Data

US 2009/0078468 A1 Mar. 26, 2009

(51) Int. Cl.
*E21B 10/36* (2006.01)

(52) U.S. Cl. ..... 175/415; 173/40; 173/91; 173/211

(58) Field of Classification Search ..... 175/135, 175/189, 293, 299, 305, 414, 415, 296; 81/465, 81/466; 173/211, 121, 118, 40, 91; 299/62, 299/69

See application file for complete search history.

(56) References Cited

U.S. PATENT DOCUMENTS 4,106,779 A * 8/1978 Zabcik ..... 277/322
4,548,278 A * 10/1985 Gidlund ..... 173/121
4,718,500 A * 1/1988 Mori ..... 173/132
5,002,136 A * 3/1991 Barthomeuf ..... 173/114
6,158,526 A * 12/2000 Ghode et al. ..... 173/93
6,854,538 B2 2/2005 Muuttonen

* cited by examiner

*Primary Examiner*—David J Bagnell
*Assistant Examiner*—Cathleen R Hutchins
(74) *Attorney, Agent, or Firm*—Stites & Harbison PLLC; Douglas E. Jackson

(57) ABSTRACT

A rock drilling machine includes a frame, and arranged inside the frame is a drill rod. A hammer gear is arranged to hammer the drill rod rear end. There is arranged around the drill rod a position sleeve and an arrangement to move position sleeve in an axial direction against hammering piston so that a counter surface of the position sleeve meets the counter surface whereby, on continuing the positioning, the drill rod is movable to the point desired. The counter surface by use of a spring element is arranged to flex in regard to the other structure of the position sleeve so that in the drilling position the sleeve is arranged to be freely backing against the front side of the drilling machine, and when in the drilling operation the positioning impact on the position sleeve against the hammering piston is removed.

4 Claims, 2 Drawing Sheets

ROCK DRILL MACHINE

FIELD OF THE INVENTION

This invention relates to a rock drill machine comprising a frame. Arranged inside the frame is a drill rod movable in an axial direction, and an arrangement to rotate the drill rod. A hammer gear, by use of which hammering pulses are generated to a piston, is arranged to hammer the drill rod rear end in order to transmit hammering pulses through the drill rod which is attachable to the drilling equipment for drilling the drill rod front end. Further, there is in this drilling machine arranged around the drill rod a position sleeve and an arrangement to move the position sleeve in an axial direction towards the hammering piston so that a counter surface in the position sleeve meets a counter surface in the drill rod whereby the drill rod can be moved to the hammering point wanted, while continuing the positioning motion.

BACKGROUND OF THE INVENTION

Previously known from Finnish patent publication 114903 is a rock drill machine like the one presented, to whose pulling gear that moves the drill rod forward during rock drilling, a separate force in the opposite direction is also directed when needed. Normally, a push force moves the pulling gear forwards and keeps it at a specified distance from the position corresponding to the hammering point of the drill rod. When the drilling equipment is to be pulled out from the hole, the pulling gear is moved towards the hammering piston, causing a transmission force in the pulling gear. Such a percussion like working is needed when pulling the drilling equipment out of the drill hole, since often the drill tries to wedge into the hole while being removed from the hole.

The disadvantage of the solution according to publication FI-114903 is that for the pulling gear a moving arrangement in both directions is needed. When the movements are done by means of pressure medium, the cylinder, piston and packing solutions become quite complicated. In addition, control valves are necessary for both positioning moves, and during pulling out the drilling equipment hammering pulses are transmitted strongly into the drill frame, since there are no spring elements.

SUMMARY OF THE INVENTION

By use of a rock drilling machine according to the invention, the need of many positioning movements and their controls are avoided. Only one moving direction has to be carried out, and when the return movement in the opposite direction is required it is freely taking place during operation of the drilling machine. During pulling out of the drilling equipment, there is due to the simple spring-arrangement a strong tendency to pull-off with the impulses, whereby the drill is not strained by harmful hammering as much as in known solutions. Also the behavior of the drilling during pulling out according to the solution of the invention departs essentially from known solutions, since energy bound to flexibility throws the drilling equipment backwards in regard to the frame in a quite other way. This solution is effective, among other things, in pulling out the drilling equipment from the hole, especially if it has already gotten stuck. It is easy to form one cylinder space in the drill frame as well as placing a piston furnished with one pressure surface in it.

BRIEF DESCRIPTION OF THE DRAWINGS

In the following, the invention is disclosed with reference to the enclosed drawings, where.

DETAILED DESCRIPTION OF THE INVENTION

Figure 1:
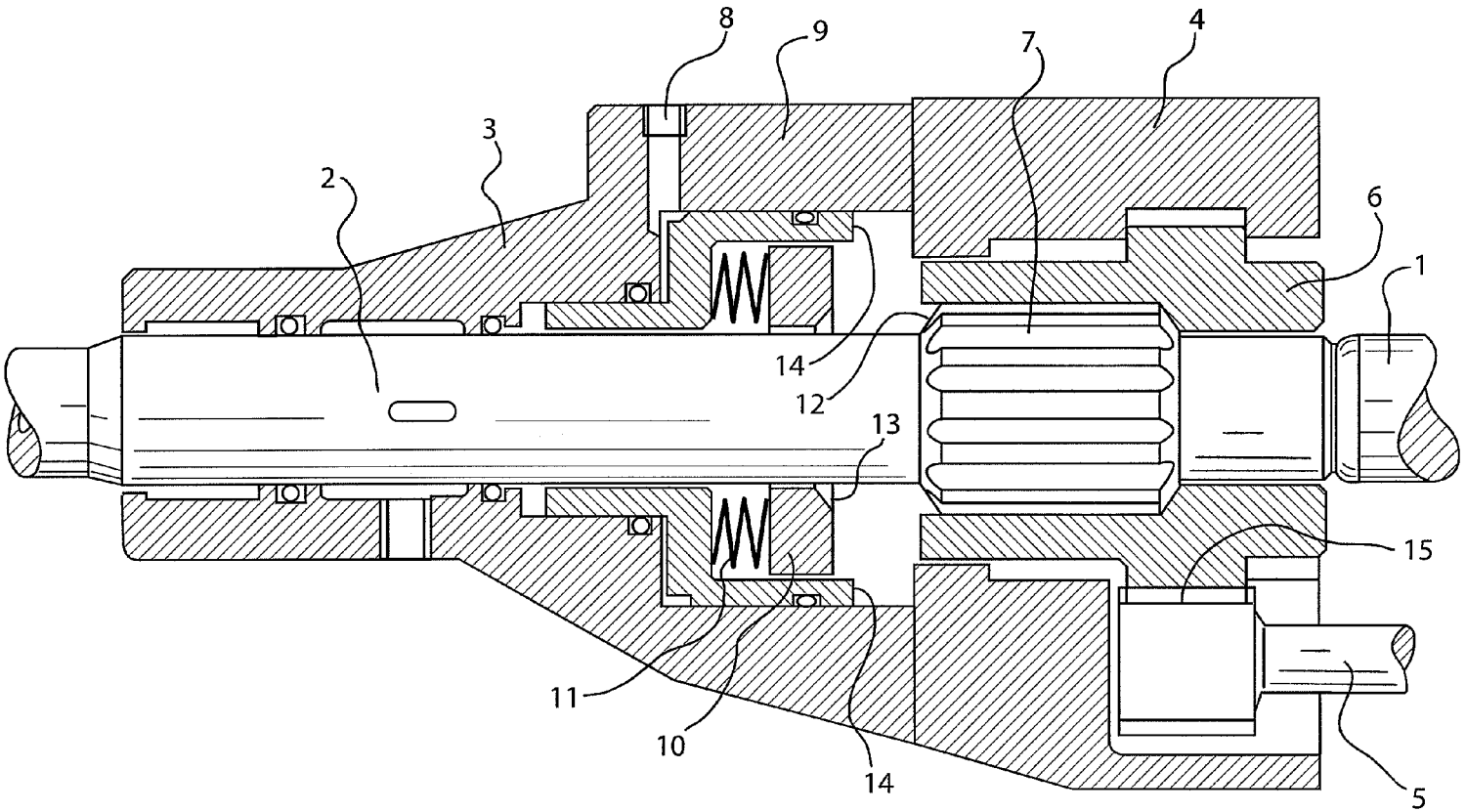
FIG. 1 shows a side cross section view of the rock drilling machine in a drilling position.

FIG. 1 shows the rock drilling machine furnished with a frame 3 and a frame 4, where there is inside of the frames 3 and 4 a drill rod 2 movable along and rotating about an axial direction thereof. Drill rod 2 is rotated by rotation axle 5 coming from a turning gear (not shown), and from which, by way of rack transmission 15, the rotation is transferred to outside sleeve 6 of drill rod 2. The inside of sleeve 6 is grooved and, correspondingly, there is on drill rod 2 a grooving 7 which transmits the rotation to drill rod 2 and which allows the drill rod 2 to move also in the axial direction as much as needed. In the drilling operation presented by FIG. 1, the back and forth moving of piston 1, which produces hammering pulses, hammers the back end of drill rod 2 and produces in the drill rod 2 forward hammering pulses. In front of drill rod 2, the hammering drilling equipment is connected, which gets the hammering pulses transmitted by drill rod 2.

The drilling machine has according to the invention a position sleeve 9 that positions the drill rod 2. In this drilling operation of FIG. 1, position sleeve 9 is freely drifted to its foremost position. As a result, position sleeve 9 is maximally spaced from counter shoulder surface 12 of drill rod 2. In particular, it will be noted that counter surface 12 does not reach to counter surface 13 of position sleeve 9 when drill rod 2 is making the back and forth hammering motion in the drilling operation. In the drilling operation shown by FIG. 1, piston 1 (which produces back and forth moving hammering pulses) always hammers the back most possible and the most wanted portion of the drill rod 2, that is moment piston 1 hammers the back end of drill rod 2. Due to hammering pulses, drill rod 2 moves a few millimeters forward and returns back. Position sleeve 9 functions like a piston in the cylinder space formed in the drilling machine frame 3. No pressure medium is led through channel 8 to the cylinder space during the drilling operation, but the pressure medium is free to flow out from the cylinder space so that position sleeve 9 can drift to the position presented in FIG. 1 and stay there. No matter the starting position when drilling commences, ultimately, the counter surface 12 of drill rod 2 hammers into position sleeve 9 via ring 10, and thus moves the position sleeve 9 to the position of FIG. 1.

By use of the new simple position sleeve 9 as set forth hereafter, a solution according to the invention is provided whereby hammering pulses are easily produced, and whereby the hammering pulses assist in the pulling out of the drilling equipment from the hole.

Figure 2:
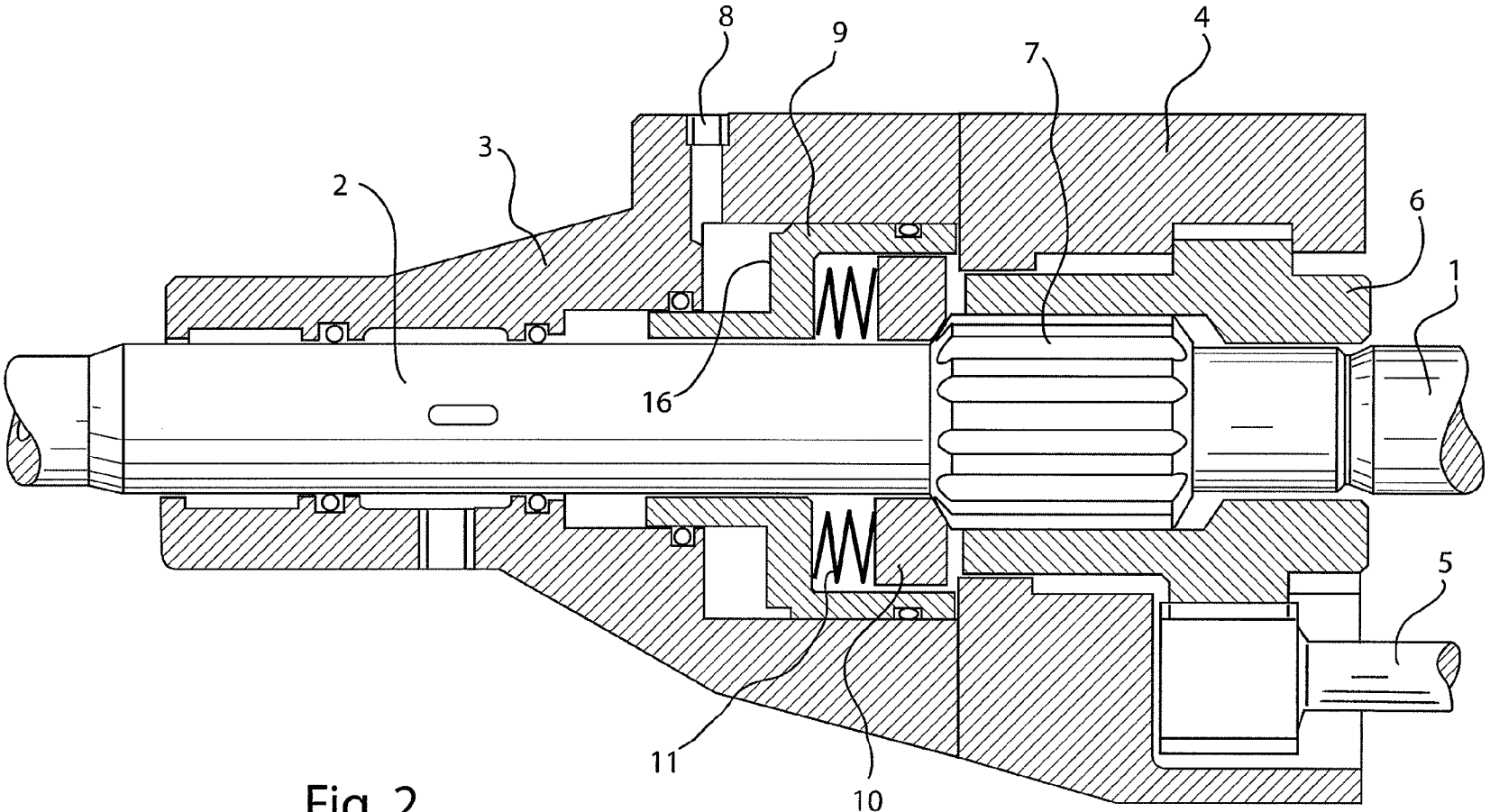
FIG. 2 shows a side cross section view of the rock drilling machine in a pulling out position.

On pulling out the drilling equipment, by use of piston 1, hammering pulses are produced, as also made during hole drilling. But in pulling out, position sleeve 9 is moved towards hammering piston 1 along drill rod 2 as shown. FIG. 1 shows that position sleeve 9 has a distance from counter surface 14 to the drilling machine rear end when position sleeve 9 is moved in that direction during drilling. In this example, rearward moving of position sleeve 9 takes place by use of a pressure medium which is transmitted through channel 8 and thus against counter surface 16 of position sleeve 9. The pressure is left in channel 8 to effect the pulling out during the whole pull-off procedure. When position sleeve 9 is in the FIG. 2 position, ring 10 is connected through spring element 11 to sleeve 9, and thus ring 10 pushes drill rod 2 always to a (rearward) starting position chosen which is towards the hammering piston. When piston 1 hammers, the hammering pulse goes from drill rod 2 through ring 20 to spring element 11 as binding (or compression) energy, and a part of the hammering to frames 3, 4. The drill equipment thus produces a slight hammering in the hole. The binding (compression) energy in spring element 11 then returns the drill rod 2 with a strong pulse against the hammering piston 1, and at the same time pulls also the drill equipment outwards in the hole.

On pulling out, while the hammering piston 1 is producing pulses to drill rod 2, the impact of the pulses can be turned to pulses which help pull out the drill equipment from the hole by use of the positioning sleeve 9 according to the invention, and by use of spring element 11 which stores and transmits energy. By pulling out, frames 3, 4 of the drilling machine are pulled by appropriate force out of the hole. Frames 3, 4 represent a great mass, and drill rod 2 and the drilling equipment a small mass and thus fast motion. Pulling out the drilling equipment from the hole is easier essentially when a small back and forth motion can be conveyed to drilling equipment in addition to just a pulling force.

The invention claimed is:

1. A rock drill machine comprising:

a frame, a drill rod arranged inside the frame and movable in an axial direction thereof, said drill rod including a rear end and a drill counter surface, a drive arrangement which rotates the drill rod, a hammering piston of a hammering device by which hammering pulses hammer the rear end of the drill rod in order to transmit hammering pulses through the drill rod, a movable sleeve arranged around the drill rod and including a sleeve counter surface, a positioning arrangement which causes movement of the movable sleeve in the axial direction toward the hammering piston so that the sleeve counter surface meets the drill counter surface, whereby the drill rod counter surface on moving away from the sleeve counter surface is movable to a hammer drilling position, wherein said movable sleeve includes a ring on which the sleeve counter surface is formed, and a spring element which is arranged to flex relative to a remainder of the movable sleeve, and wherein in a non-drilling operation, the sleeve counter surface is arranged to be freely located against the drill counter surface whereby the sleeve counter surface receives hammering pulses from the drill rod which is transmitted to the spring element and the spring element returns the hammering pulses to the drill rod, and wherein in a drilling operation, the sleeve counter surface is spaced from the drill counter surface so that no hammering pulses are received.

2. A rock drill machine according to claim 1 wherein the frame includes a cylinder space therein and the movable sleeve is movable in the cylinder space, whereby the movable sleeve functions as a pressure piston which is movable by a medium introduced into the cylinder space.

3. A rock drill machine according to claim 1 wherein movable sleeve has a second sleeve counter surface which is directed toward the hammering piston, and wherein the frame includes a frame counter surface which restricts the positioning of the movable sleeve to an intended point during the drilling operation and also moves the drill rod use of the movable sleeve towards the hammering piston to a second intended point when pulling the drill rod out from a hole during the non-drilling operation even while the hammering piston is still producing hammering pulses.

4. A rock drilling machine according to claim 1 wherein the spring element is helical spring.

* * * * *